US011646147B2

(12) United States Patent
Yoshinaka et al.

(10) Patent No.: US 11,646,147 B2
(45) Date of Patent: May 9, 2023

(54) COIL COMPONENT

(71) Applicant: Murata Manufacturing Co., Ltd., Kyoto-fu (JP)

(72) Inventors: Keiichi Yoshinaka, Nagaokakyo (JP); Masahiro Hayashi, Nagaokakyo (JP); Hiroyuki Kanbara, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 392 days.

(21) Appl. No.: 16/854,336

(22) Filed: Apr. 21, 2020

(65) Prior Publication Data

US 2020/0373063 A1 Nov. 26, 2020

(30) Foreign Application Priority Data

May 23, 2019 (JP) ..... JP2019-096862

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/2804* (2013.01); *H01F 27/29* (2013.01); *H01F 27/32* (2013.01); *H01F 41/043* (2013.01); *H01F 41/12* (2013.01); *H01F 2027/2809* (2013.01)

(58) Field of Classification Search

CPC ..... H01F 27/2804; H01F 27/29; H01F 27/32; H01F 41/043; H01F 41/12; H01F 2027/2809

See application file for complete search history.

(56) References Cited

U.S. PATENT DOCUMENTS

| | | | | |
|---|---|---|---|---|
| 2013/0200980 | A1 | 8/2013 | Yokoyama et al. | |
| 2014/0253277 | A1* | 9/2014 | Takezawa | H01F 27/2804 336/200 |
| 2014/0306792 | A1 | 10/2014 | Yoneda et al. | |
| 2014/0313005 | A1* | 10/2014 | Bang | H01F 27/292 336/200 |
| 2014/0368307 | A1* | 12/2014 | Kato | H01F 27/343 336/200 |

(Continued)

FOREIGN PATENT DOCUMENTS

| | | |
|---|---|---|
| JP | H05-121240 A | 5/1993 |
| JP | H08-088126 A | 4/1996 |

(Continued)

OTHER PUBLICATIONS

An Office Action; "Notice of Reasons for Refusal," mailed by the Japanese Patent Office dated Dec. 21, 2021, which corresponds to Japanese Patent Application No. 2019-096862 and is related to U.S. Appl. No. 16/854,336 with English language translation.

*Primary Examiner* — Michael P McFadden

(74) *Attorney, Agent, or Firm* — Studebaker & Brackett PC

(57) ABSTRACT

The present disclosure provides a coil component including an element assembly containing a filler and a resin material, a coil portion composed of a coil conductor embedded in the element assembly, and a pair of outer electrodes electrically coupled to the coil conductor. A relatively thin first conductor layer and a relatively thick second conductor layer are stacked in the coil conductor.

23 Claims, 6 Drawing Sheets

(56) References Cited

U.S. PATENT DOCUMENTS

| | | | | |
|---|---|---|---|---|
| 2016/0351321 | A1* | 12/2016 | Lyoo | H01F 41/041 |
| 2017/0125154 | A1* | 5/2017 | Karino | H03H 7/38 |
| 2017/0125159 | A1* | 5/2017 | Karino | H01F 27/33 |
| 2017/0287622 | A1 | 10/2017 | Ishizaki | |
| 2018/0090266 | A1 | 3/2018 | Sano et al. | |
| 2019/0146339 | A1 | 5/2019 | Kondo | |

FOREIGN PATENT DOCUMENTS

| | | | |
|---|---|---|---|
| JP | 2013-162101 | A | 8/2013 |
| JP | 2014-139981 | A | 7/2014 |
| JP | 2014-207280 | A | 10/2014 |
| JP | 2015-156432 | A | 8/2015 |
| JP | 2016-201466 | A | 12/2016 |
| JP | 2017-011185 | A | 1/2017 |
| JP | 2017-183529 | A | 10/2017 |
| JP | 2018-050015 | A | 3/2018 |
| WO | 2014/061670 | A1 | 4/2014 |
| WO | 2018/016480 | A1 | 1/2018 |

* cited by examiner

COIL COMPONENT

CROSS-REFERENCE TO RELATED APPLICATION

This application claims benefit of priority to Japanese Patent Application No. 2019-096862, filed May 23, 2019, the entire content of which is incorporated herein by reference.

BACKGROUND

Technical Field

The present disclosure relates to a coil component.

Background Art

Regarding coil components in which a coil conductor is embedded in an element assembly portion, a coil component in which an α-winding coil is embedded in an element assembly composed of a composite material containing metal particles and a resin material is known, as described, for example, in Japanese Unexamined Patent Application Publication No. 2016-201466.

The above composite material containing the resin material may be used to produce the above-described coil component by preparing a composite material sheet containing the resin material, placing a coil thereon, covering the coil with another composite material sheet from above, and performing compression forming. In the case in which a coil component is produced by interposing a separately formed α-winding coil between the composite material sheets, it is difficult to reduce the coil in size, and a reduction in size makes it difficult to sufficiently reduce direct-current resistance (Rdc).

SUMMARY

Accordingly, the present disclosure provides a small and low-direct-current resistance coil component in which a coil portion is embedded in an element assembly containing a resin material.

The present disclosure includes the following aspects.

(1) A coil component including an element assembly containing a filler and a resin material, a coil portion composed of a coil conductor embedded in the element assembly, and a pair of outer electrodes electrically coupled to the coil conductor. A relatively thin first conductor layer and a relatively thick second conductor layer are stacked in the coil conductor.

(2) The coil component according to (1) above, wherein the second conductor layer is interposed between the first conductor layers.

(3) The coil component according to (1) or (2) above, wherein the second conductor layer and the first conductor layers are stacked alternately and the outermost layer is the first conductor layer.

(4) The coil component according to any one of (1) to (3) above, wherein the width of the first conductor layer is relatively large and the width of the second conductor layer is relatively small.

(5) The coil component according to any one of (1) to (4) above, wherein the coil conductor is covered with a glass layer.

(6) The coil component according to any one of (1) to (5) above, wherein the thickness of the glass layer is 3 μm or more and 30 μm or less (i.e., from 3 μm to 30 μm).

(7) The coil component according to any one of (1) to (6) above, wherein the thickness of the coil conductor is 10 μm or more and 500 μm or less (i.e., from 10 μm to 500 μm).

Other features, elements, characteristics, and advantages of the present disclosure will become more apparent from the following detailed description of preferred embodiments of the present disclosure with reference to the attached drawings.

DETAILED DESCRIPTION

A coil component according to the present disclosure will be described below in detail with reference to the drawings. However, the shapes, the arrangements, and the like of the coil component and constituent elements of the present embodiment are not limited to the examples illustrated.

Figure 1:
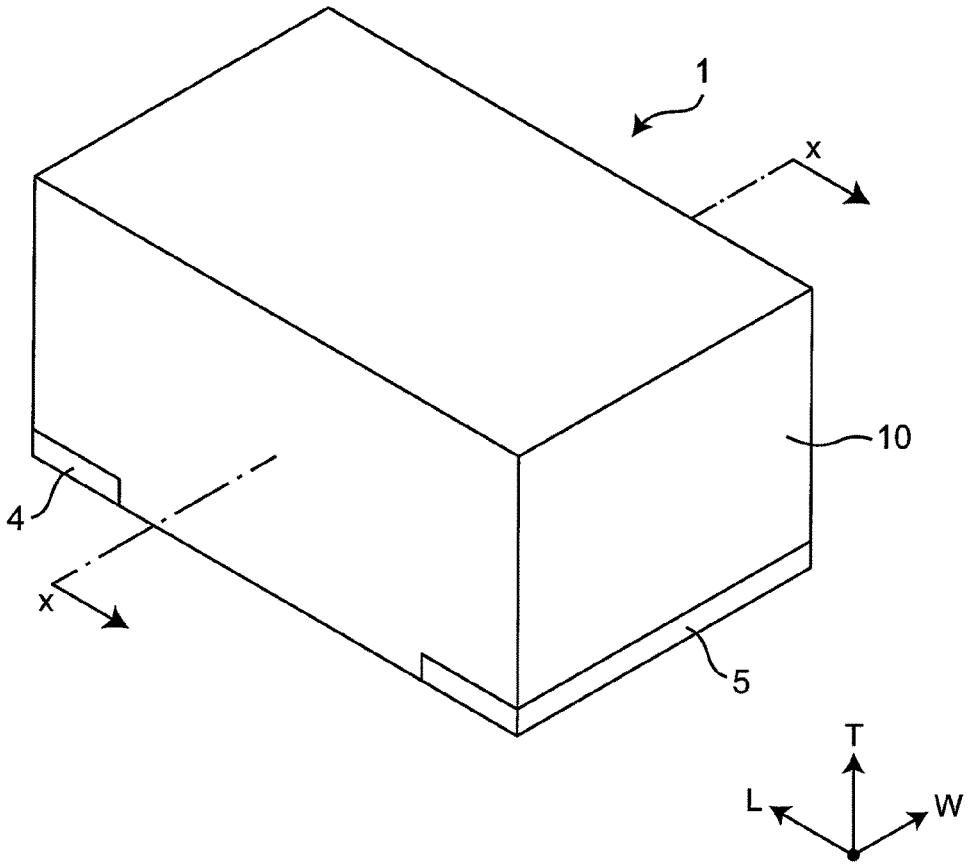
FIG. 1 is a perspective view showing a coil component according to an embodiment of the present disclosure.
Figure 2:
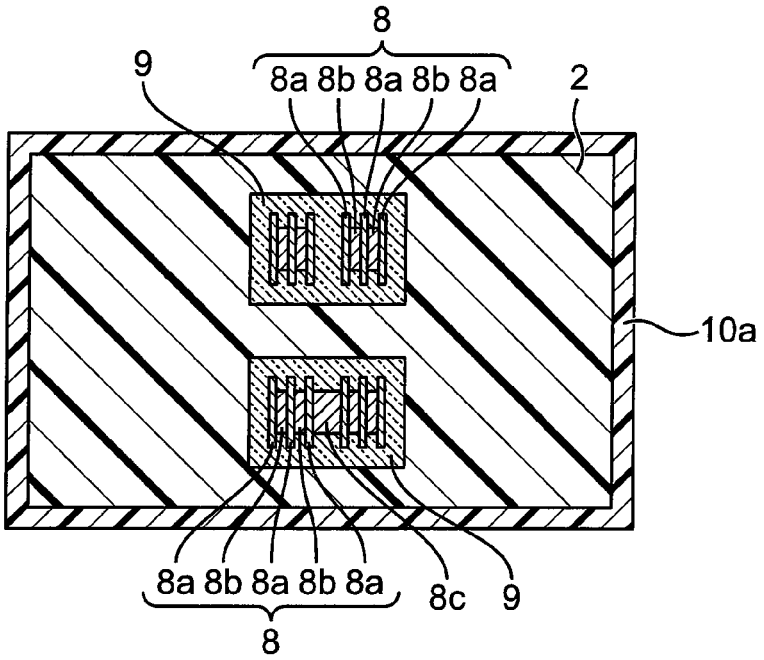
FIG. 2 is a sectional view showing a cross section of the coil component cut along line x-x in FIG. 1.
Figure 3:
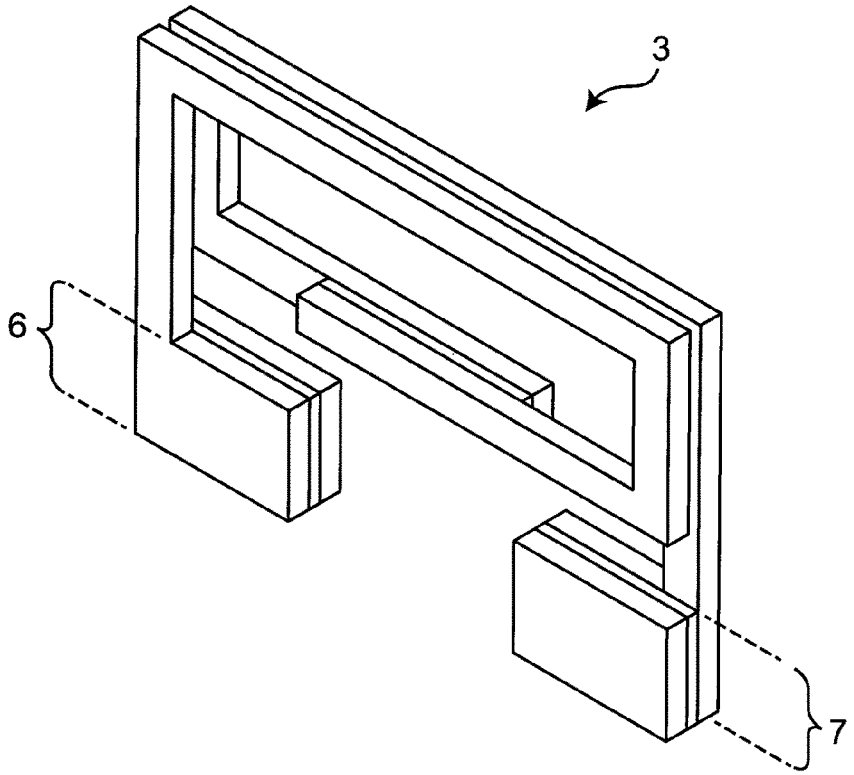
FIG. 3 is a perspective view showing a coil portion of the coil component in FIG. 1.

FIG. 1 is a perspective view showing a coil component 1 according to the present embodiment, and FIG. 2 is a sectional view. FIG. 3 is a perspective view showing a coil portion 3 of the coil component 1. However, in FIG. 3, a first conductor layer and a second conductor layer in the coil portion 3 are integrally expressed for the sake of simplification.

As shown in FIG. 1 to FIG. 3, the coil component 1 according to the present embodiment has a substantially rectangular parallelepiped shape. In the coil component 1, the surfaces in the right and left portions of FIG. 2 are denoted as "end surfaces", the surface in the upper portion of FIG. 2 is denoted as an "upper surface", the surface in the lower portion of FIG. 2 is denoted as a "lower surface", the surface in the near portion of FIG. 2 is denoted as a "front surface", and the surface in the far portion of FIG. 2 is denoted as a "back surface". The coil component 1 typically includes an element assembly 2, a coil portion 3 embedded in the element assembly 2, and a pair of outer electrodes 4 and 5. The coil portion 3 has an axis in the front surface-back surface direction of the element assembly; that is, an axis parallel to a mounting surface. As shown in FIG. 3, the coil portion 3 includes a plurality of coil conductors 8 and connection conductor 8*c* to couple the coil conductors 8 to each other. The coil portion 3 includes extended portions 6 and 7, and the extended portions 6 and 7 are electrically coupled to outer electrodes 4 and 5, respectively. As shown in FIG. 2, in each coil conductor 8, three first conductor layers 8*a* and two second conductor layers 8*b* are alternately stacked such that the first conductor layers 8*a* serve as the outermost layers. The thickness of the first conductor layer 8*a* (thickness in the lateral direction in FIG. 2) is thinner than the thickness of the second conductor layer 8*b* (thickness in the lateral direction in FIG. 2). The width of the first conductor layer 8*a* (width in the vertical direction in FIG. 2) is greater than the width of the second conductor layer 8*b* (width in the vertical direction in FIG. 2). That is, each side surface of the coil conductor 8 (for example, the upper or lower surface in FIG. 2) has grooves in which the second conductor layer 8*b* is a bottom and two first conductor layers 8*a* are wall surfaces. The coil portion 3 is covered with a glass layer 9. In addition, the coil component 1 excluding the outer electrodes 4 and 5 is covered with an insulating layer 10.

In the present specification, the length of the coil component 1 is denoted as "L", the width is denoted as "W", and the thickness (height) is denoted as "T" (refer to FIG. 1). In the present specification, the surface parallel to the front surface and the back surface is denoted as the "LT plane", the surface parallel to the end surface is denoted as the "WT plane", and the surface parallel to the upper surface and the lower surface is denoted as the "LW plane".

The element assembly 2 is composed of a composite material containing a filler and a resin material.

There is no particular limitation regarding the resin material, and examples of the resin material include thermosetting resins such as epoxy resins, phenol resins, polyester resins, polyimide resins, and polyolefin resins. The resin material may be at least one type.

The filler is preferably metal particles, ferrite particles, or glass particles, and more preferably metal particles. One type of the filler may be used alone, or a plurality of types may be used in combination.

According to an aspect, the filler has an average particle diameter of preferably about 0.5 μm or more and 50 μm or less (i.e., from about 0.5 μm to 50 μm), more preferably about 0.5 μm or more and 30 μm or less (i.e., from about 0.5 μm to 30 μm), and further preferably about 0.5 μm or more and 10 μm or less (i.e., from about 0.5 μm to 10 μm). Setting the average particle diameter of the filler to be about 0.5 μm or more enables the filler to be readily handled. Meanwhile, setting the average particle diameter of the filler to be about 50 μm or less enables the filling ratio of the filler to be increased and enables the characteristics of the filler to be more effectively obtained. For example, in the case in which the filler is metal particles, the magnetic characteristics are improved.

In this regard, the average particle diameter is calculated on the basis of the equivalent circle diameters of the filler in a SEM (scanning electron microscope) image of a cross section of the element assembly. For example, the average particle diameter can be obtained by taking SEM images of a plurality of (for example, five) regions (for example, 130 μm×100 μm) in a cross section obtained by cutting the coil component 1, analyzing the resulting SEM images by using image analysis software (for example, Azokun (registered trademark) produced by Asahi Kasei Engineering Corporation) so as to determine the equivalent circle diameters of 500 or more metal particles, and calculating the average.

There is no particular limitation regarding the metal material constituting the metal particles, and examples of the metal material include iron, cobalt, nickel, and gadolinium or alloys containing at least one of these. The metal material is preferably iron or an iron alloy. Iron may be iron only or an iron derivative, for example, a complex. There is no particular limitation regarding the iron derivative, and examples of the iron derivative include iron carbonyl, which is a complex of iron and CO, and preferably iron pentacarbonyl. In particular, a hard-grade iron carbonyl (for example, a hard-grade iron carbonyl produced by BASF) having an onion skin structure (structure in which concentric-sphere-shaped layers are formed around the center of a particle) is preferable. There is no particular limitation regarding the iron alloy, and examples of the iron alloy include Fe—Si-based alloys, Fe—Si—Cr-based alloys, Fe—Si Al-based alloys, Fe—Ni-based alloys, Fe—Co-based alloys, and Fe—Si B—Nb—Cu-based alloys. The above-described alloys may further contain B, C, and the like as other secondary components. There is no particular limitation regarding the content of the secondary components, and the content may be, for example, about 0.1% by weight or more and 5.0% by weight or less (i.e., from about 0.1% by weight to 5.0% by weight) and preferably about 0.5% by weight or more and 3.0% by weight or less (i.e., from about 0.5% by weight to 3.0% by weight). The above-described metal material may be at least one type.

The surfaces of the metal particles may be covered with a coating film of an insulating material (hereafter also simply referred to as "insulating coating film"). Coverage of the surfaces of the metal particles with the insulating coating film enables the internal specific resistance of the element assembly to increase.

The surfaces of the metal particles may be covered with the insulating coating film to the extent that insulation performance between particles can be enhanced, and merely part of the surface of each of the metal particles may be covered with the insulating coating film. There is no particular limitation regarding the form of the insulating coating film, and the form of a network or a layer may be adopted. In a preferred aspect, regarding each of the metal particles, the region corresponding to about 30% or more, preferably about 60% or more, more preferably about 80% or more, further preferably about 90% or more, and particularly preferably 100% of the surface may be covered with the insulating coating film.

There is no particular limitation regarding the thickness of the insulating coating film, and the thickness may be preferably about 1 nm or more and 100 nm or less (i.e., from about 1 nm to 100 nm), more preferably about 3 nm or more and 50 nm or less (i.e., from about 3 nm to 50 nm), further preferably about 5 nm or more and 30 nm or less (i.e., from about 5 nm to 30 nm), and may be, for example, about 10 nm or more and 30 nm or less (i.e., from about 10 nm to 30 nm) or about 5 nm or more and 20 nm or less (i.e., from about 5 nm to 20 nm). Increasing the thickness of the insulating coating film enables the specific resistance of the element assembly to be enhanced. Meanwhile, decreasing the thickness of the insulating coating film enables the amount of the metal material in the element assembly to be increased, enables the magnetic characteristics of the element assembly to be improved, and enables the coil component to be readily reduced in size.

According to an aspect, the insulating coating film is formed of an insulating material containing Si. Examples of the insulating material containing Si include silicon-based compounds such as $SiO_x$ (x is 1.5 or more and 2.5 or less, and $SiO_2$ is a representative).

According to an aspect, the insulating coating film is an oxide film formed by oxidizing the surface of the metal particles.

There is no particular limitation regarding the coating method of the insulating coating film, and a coating method known to a person skilled in the art, for example, a sol-gel method, a mechanochemical method, a spray dry method, a fluidized-bed granulation method, an atomization method, or a barrel-sputtering method, may be used.

There is no particular limitation regarding the ferrite material constituting the ferrite particles, and examples of the ferrite material include ferrite materials containing Fe, Zn, Cu, and Ni as primary components.

According to an aspect, the ferrite particles may be covered with an insulating coating film in the same manner as the metal particles above. Coverage of the surfaces of the ferrite particles with the insulating coating film enables the internal specific resistance of the element assembly to increase.

There is no particular limitation regarding the glass material constituting the glass particles, and examples of the glass material include Bi—B—O-based glass, V—P—O-based glass, Sn—P—O-based glass, and V—Te—O-based glass.

As shown in FIG. 2 and FIG. 3, in the coil component 1 according to the present embodiment, to electrically couple the two coil conductors 8 to each other, the coil portion 3 includes a connection conductor 8*c*. Both ends of the coil portion 3 are extended to the lower portion of the element assembly 2 by the extended portions 6 and 7 and are exposed at the lower surface of the element assembly 2. Each coil conductor 8 is composed of the first conductor layers 8*a* and the second conductor layers 8*b*.

In the coil component 1 according to the present embodiment, the first conductor layers 8*a* and the second conductor layers 8*b* are alternately stacked such that the first conductor layers 8*a* serve as the outermost layers. For more details, the three first conductor layers 8*a* and the two second conductor layers 8*b* are stacked in the order of (first conductor layer 8*a*)-(second conductor layer 8*b*)-(first conductor layer 8*a*)-(second conductor layer 8*b*)-(first conductor layer 8*a*). In this regard, the outermost layers denote conductor layers located at the outermost positions, in other words, located as the lowermost layer and the uppermost layer, in the stacked conductor layers.

In the coil conductor 8, the thickness of the first conductor layer 8*a* is relatively small, and the thickness of the second conductor layer 8*b* is relatively large.

The ratio of the thickness of the second conductor layer 8*b* to the thickness of the first conductor layer 8*a* (second conductor layer/first conductor layer) is preferably about 1.1 or more and 10 or less (i.e., from about 1.1 to 10), more preferably about 1.5 or more and 5.0 or less (i.e., from about 1.5 to 5.0), and further preferably about 2.0 or more and 5.0 or less (i.e., from about 2.0 to 5.0).

The thickness of the first conductor layer 8*a* is preferably about 1 μm or more and 200 μm or less (i.e., from about 1 μm to 200 μm), more preferably about 3 μm or more and 100 μm or less (i.e., from about 3 μm to 100 μm), and further preferably about 5 μm or more and 100 μm or less (i.e., from about 5 μm to 100 μm). Setting the thickness of the first conductor layer 8*a* to be about 1 μm or more increases the thickness of the coil conductor 8 and reduces the direct-current resistance of the coil conductor 8. Meanwhile, setting the thickness of the first conductor layer 8*a* to be about 200 μm or less facilitates production of the coil conductor 8.

The thickness of the second conductor layer 8*b* is preferably about 3 μm or more and 300 μm or less, more preferably about 5 μm or more and 200 μm or less (i.e., from about 5 μm to 200 μm), and further preferably about 10 μm or more and 150 μm or less (i.e., from about 10 μm to 150 μm). Setting the thickness of the second conductor layer 8*b* to be about 3 μm or more increases the thickness of the coil conductor 8 and reduces the direct-current resistance of the coil conductor 8. Meanwhile, setting the thickness of the second conductor layer 8*b* to be about 300 μm or less facilitates production of the coil conductor 8.

The thickness of the coil conductor 8 is preferably about 10 μm or more and 500 μm or less (i.e., from about 10 μm to 500 μm), more preferably about 20 μm or more and 300 μm or less (i.e., from about 20 μm to 300 μm), and further preferably about 30 μm or more and 150 μm or less (i.e., from about 30 μm to 150 μm). Setting the thickness of the coil conductor 8 to be about 10 μm or more enables the direct-current resistance of the coil conductor 8 to be reduced. Further increasing the thickness of the coil conductor 8 enables the direct-current resistance of the coil conductor 8 to be further reduced. Meanwhile, setting the thickness of the coil conductor 8 to be about 500 μm or less enables the coil component to be reduced in size. Decreasing the thickness of the coil conductor 8 enables the coil component to be further reduced in size.

The width of the first conductor layer 8*a* (width in the vertical direction in FIG. 2) is greater than the width of the second conductor layer 8*b* (width in the vertical direction in FIG. 2). That is, each side surface of the coil conductor 8 (the upper or lower surface in FIG. 2) has two grooves in which the second conductor layer 8*b* is a bottom and two first conductor layers 8*a* are wall surfaces. Setting the width of the first conductor layer 8*a* to be greater than the width of the second conductor layer 8*b* enables the distance between a portion that is the first conductor layer 8*a* and the element assembly that is a magnetic substance to decrease and enables the magnetic flux density to increase.

The ratio of the width of the second conductor layer 8*b* to the width of the first conductor layer 8*a* (second conductor layer/first conductor layer) is preferably about 1.1 or more and 3.0 or less (i.e., from about 1.1 to 3.0), more preferably about 1.3 or more and 2.5 or less (i.e., from about 1.3 to 2.5), and further preferably about 1.5 or more and 2.0 or less (i.e., from about 1.5 to 2.0).

The width of the first conductor layer 8*a* (width in the vertical direction in FIG. 2) is preferably about 5 μm or more and 1 mm or less (i.e., from about 5 μm to 1 mm), more preferably about 10 μm or more and 500 μm or less (i.e., from about 10 μm to 500 μm), further preferably about 15 μm or more and 300 μm or less (i.e., from about 15 μm to 300 μm), and further preferably about 20 μm or more and 100 μm or less i.e., from about 20 μm to 100 μm). Setting the width of the first conductor layer 8*a* to be about 5 μm or more enables the direct-current resistance of the coil conductor 8 to be reduced. Further increasing the width of the first conductor layer 8*a* enables the direct-current resistance of the coil conductor 8 to be further reduced. Meanwhile, setting the width of the first conductor layer 8*a* to be about 1 mm or less enables the coil component to be reduced in size. Further decreasing the width of the first conductor layer 8*a* enables the coil component to be further reduced in size.

The width of the second conductor layer 8*b* (width in the vertical direction in FIG. 2) is preferably about 3 μm or more and 800 μm or less (i.e., from about 3 μm to 800 μm), more preferably about 5 μm or more and 300 μm or less (i.e., from about 5 μm to 300 μm), further preferably about 10 μm or more and 200 μm or less (i.e., from about 10 μm to 200 μm), and further preferably about 15 μm or more and 80 μm or less (i.e., from about 15 μm to 80 μm). Setting the width of the second conductor layer 8*b* to be about 3 μm or more enables the direct-current resistance of the coil conductor 8 to be reduced. Further increasing the width of the second conductor layer 8*b* enables the direct-current resistance of the coil conductor 8 to be further reduced. Meanwhile, setting the width of the second conductor layer 8*b* to be about 800 μm or less enables the coil component to be reduced in size. Further decreasing the width of the second conductor layer 8*b* enables the coil component to be further reduced in size.

In this regard, in the coil component 1 according to the present embodiment, three first conductor layers 8*a* and two second conductor layers 8*b* are alternately stacked, but the coil component according to the present disclosure is not limited to such an embodiment.

In the coil component according to the present disclosure, the number of the first conductor layers 8*a* may be two or more and preferably 3 or more. Meanwhile, the number of the first conductor layers 8*a* may be 6 or less, preferably 4 or less, and more preferably 3 or less. For example, the number of the first conductor layers 8*a* may be 2, 3, 4, or 5, preferably 2 or 3, and more preferably 3.

In the coil component according to the present disclosure, the number of the second conductor layers 8*b* is preferably one less than the number of the first conductor layers 8*a*. The number of the second conductor layers 8*b* may be 1 or more and preferably 2 or more. Meanwhile, the number of the second conductor layers 8*b* may be 5 or less, preferably 3 or less, and more preferably 2 or less. For example, the number of the second conductor layers 8*b* may be 1, 2, 3, or 4, preferably 1 or 2, and more preferably 2.

In the coil component according to the present disclosure, the first conductor layers 8*a* and the second conductor layers 8*b* are not limited to being alternately stacked but are preferably alternately stacked.

In the coil component according to the present disclosure, the first conductor layer 8*a* and the second conductor layer 8*b* are not limited to being formed separately from each other and may be formed in a single operation. For example, a first conductor layer and a second conductor layer adjacent to each other may be integrally formed in a single operation. For example, one first conductor layer 8*a* in FIG. 2 and one second conductor layer 8*b* adjacent to each other may be integrally formed. In this case, a wide portion is assumed to be the first conductor layer 8*a* and a narrow portion is assumed to be the second conductor layer 8*b*.

The axis of the coil portion 3 is parallel to the mounting surface; that is, the axis of the coil portion 3 extends in the direction from the front surface of the element assembly 2 toward the back surface (that is, the W-direction). Setting the axis of the coil portion to be parallel to the mounting surface enables the extended portions of the coil to extend from the same surface side of the element assembly. That is, in FIG. 3, both of the extended portions 6 and 7 can extend from the lower surface side. On the other hand, in the case in which the coil portion is formed such that the axis extends perpendicularly to the mounting surface, the two ends of the coil are located on the lower surface side and the upper surface side of the element assembly, and one of the extended portions has to extend from the upper surface to the lower surface along the side surface. Therefore, setting the axis of the coil to be parallel to the mounting surface enables the size of the extended portion formed beside the winding portion of the coil portion to be reduced and eliminates the need to form the extended portion beside the winding portion. In other words, the size of a region in which the winding portion of the coil is opposite the extended portion can be reduced and the region can be eliminated. Consequently, stray capacitance generated between the winding portion and the extended portion can be reduced. In addition, since the diameter of the winding can be increased, the L-value acquisition efficiency can be increased. In this regard, the number of turns of the coil portion 3 of the coil component 1 is 1.5. However, there is no particular limitation regarding the number of turns of the coil component according to the present disclosure, and the number of turns may be appropriately selected in accordance with intended purpose.

There is no particular limitation regarding the conductive material constituting the coil conductor 8, and examples of the conductive material include gold, silver, copper, palladium, and nickel. The conductive material is preferably silver or copper and more preferably silver. The conductive material may be at least one type.

The coil portion 3 includes extended portions 6 and 7. The extended portions 6 and 7 extend from the wiring portion of the coil portion toward the respective outer electrodes and are electrically coupled to outer electrodes 4 and 5, respectively.

The width of the coil conductor in the extended portion is preferably about 1.0 times or more and 6.0 times or less (i.e., from about 1.0 times to 6.0 times) the width of the first conductor layer in the winding portion, more preferably more than about 1.0 times and about 6.0 times or less (i.e., from more than about 1.0 times to about 6.0 times), further preferably about 1.5 times or more and 5.0 times or less (i.e., from about 1.5 times to 5.0 times), and further preferably about 2.0 times or more and 4.0 times or less (i.e., from about 2.0 times to 4.0 times). In this regard, the width of the coil conductor in the extended portion denotes the width of a portion in contact with the outer electrode and denotes the width in the L-direction in the present embodiment. Setting the width of the coil conductor in the extended portion to be about 1.0 times or more the width of the first conductor layer in the winding portion further ensures the coupling to the outer electrode and improves reliability.

In the coil component according to the present disclosure, the coil conductor 8 is covered with the glass layer 9.

There is no particular limitation regarding the glass material constituting the glass layer 9. Examples of the glass material include $SiO_2$—$B_2O_3$-based glass, $SiO_2$—$B_2O_3$—$K_2O$-based glass, $SiO_2$—$B_2O_3$—$Li_2O$—CaO-based glass, $SiO_2$—$B_2O_3$—$Li_2O$—CaO—ZnO-based glass, and $Bi_2O_3$—$B_2O_3$—$SiO_2$—$Al_2O_3$-based glass. In a preferred aspect, the glass material is $SiO_2$—$B_2O_3$—$K_2O$-based glass. Using $SiO_2$—$B_2O_3$—$K_2O$-based glass enhances the sinterability during formation of the glass layer.

According to an aspect, the glass layer 9 may further contain a filler. Examples of the filler contained in the glass layer include quartz, alumina, magnesia, silica, forsterite, steatite, and zirconia.

The thickness of the glass layer 9 is preferably about 3 μm or more and 30 μm or less (i.e., from about 3 μm to 30 μm) and more preferably about 5 μm or more and 20 μm or less (i.e., from about 5 μm to 20 μm). Setting the thickness of the glass layer 9 to be about 3 μm or more enables the coil portion to be more firmly supported and enables the insulation performance between the coil portion and the element assembly to be enhanced. Meanwhile, setting the thickness of the glass layer 9 to be about 30 μm or less enables the coil component to be reduced in size. In this regard, the thickness of the glass layer denotes the thickness under the assumption that the groove in the side surface of the coil conductor 8 is filled. For example, in FIG. 2, the thickness of the glass layer on the principal surface side of the coil conductor 8 is the length from a position in contact with the principal surface of the first conductor layer 8*a* to a position in contact with the element assembly 2 in the lateral direction, and the thickness of the glass layer on the side surface side of the coil conductor 8 is the length from a position in contact with the side surface of the first conductor layer 8*a* to a position in contact with the element assembly 2 in the vertical direction.

Each of the outer electrodes 4 and 5 is disposed on the lower surface of the coil component 1. Disposing the outer electrodes on the lower surface enables the coil component 1 to be surface-mounted. In addition, stray capacitance is reduced compared with the case in which the outer electrodes are disposed on the end surface.

The outer electrodes 4 and 5 are disposed on the extended portions 6 and 7, respectively, of the coil portion 3 that extend to the lower surface of the element assembly 2. That is, the outer electrodes 4 and 5 are electrically coupled to the extended portions 6 and 7, respectively, of the coil portion 3.

The outer electrodes 4 and 5 may extend to not only the extended portions 6 and 7 of the coil portion 3 that extend to the lower surface of the element assembly 2 but also other portions of the lower surface of the coil component beyond the terminal portion of the coil conductor.

The outer electrodes 4 and 5 are disposed on the entire region in which the insulating layer 10 is not present; that is, the entire region at which the element assembly 2 and the coil portion 3 are exposed.

The outer electrodes 4 and 5 are not limited to the above-described aspect provided that the outer electrodes 4 and 5 are electrically coupled to the extended portions 6 and 7, respectively, of the coil portion 3. For example, in the coil component according to the present disclosure, the outer electrodes 4 and 5 may extend to the end surface of the coil component.

There is no particular limitation regarding the thickness of each outer electrode, and the thickness may be, for example, about 1 μm or more and 100 μm or less (i.e., from about 1 μm to 100 μm), preferably about 5 μm or more and 50 μm or less (i.e., from about 5 μm to 50 μm), and more preferably about 5 μm or more and 20 μm or less (i.e., from about 5 μm to 20 μm).

The outer electrodes are composed of a conductive material and preferably at least one metal material selected from a group consisting of Au, Ag, Pd, Ni, Sn, and Cu.

The outer electrodes are formed by applying plating or a paste containing a conductive material and by performing curing or baking and are preferably formed by plating.

Each outer electrode may be a single layer electrode or a multilayer electrode.

According to an aspect, each outer electrode is a multilayer electrode. Preferably, the outer electrode is composed of three layers of a Cu layer, a Ni layer, and a Sn layer or a two layers of a Ni layer and a Sn layer. Forming the Cu layer on the element assembly 2 enables the adhesiveness of the plating to the element assembly to be enhanced.

According to an aspect, preferably, each outer electrode is composed of three layers of a Ag layer, a Ni layer, and a Sn layer. The Ag layer may be formed by applying a paste containing a Ag powder and a resin and by performing heat curing or be formed by applying a paste containing a Ag powder and a resin and by performing baking. The Ni layer and the Sn layer are successively formed thereon by plating.

The coil component 1 excluding the outer electrodes 4 and 5 is covered with the insulating layer 10.

There is no particular limitation regarding the thickness of the insulating layer 10, and the thickness may be preferably about 3 μm or more and 20 μm or less (i.e., from about 3 μm to 20 μm), more preferably about 3 μm or more and 10 μm or less (i.e., from about 3 μm to 10 μm), and further preferably about 3 μm or more and 8 μm or less (i.e., from about 3 μm to 8 μm). Setting the thickness of the insulating layer to be within the above-described range enables the insulation performance of the surface of the coil component 1 to be ensured while an increase in the size of the coil component 1 is suppressed.

Examples of the material constituting the insulating layer 10 include resin materials having high electrical insulation performance such as acrylic resins, epoxy resins, and polyimides, and the insulating layer 10 may be formed of at least two types of resin materials. Adoption of two-layer structure of an acrylic resin and an epoxy resin is more preferable because the impact resistance is improved.

In the coil component according to the present disclosure, the insulating layer 10 is not indispensable and may be omitted.

Regarding the coil component according to the present disclosure, the direct-current resistance can be reduced and the size can be reduced.

According to an aspect, the direct-current resistance of the coil component according to the present disclosure is about 100 mΩ or less and preferably 80 mΩ or less.

According to an aspect, the length (L) of the coil component according to the present disclosure is preferably about 0.38 mm or more and 1.75 mm or less (i.e., from about 0.38 mm to 1.75 mm) and more preferably about 0.38 mm or more and 1.05 mm or less (i.e., from about 0.38 mm to 1.05 mm). According to an aspect, the width (W) of the coil component according to the present disclosure is preferably about 0.18 mm or more and 0.95 mm or less (i.e., from about 0.18 mm to 0.95 mm) and more preferably about 0.18 mm or more and 0.55 mm or less (i.e., from about 0.18 mm to 0.55 mm). In a preferred aspect, the coil component according to the present disclosure has a length (L) of about 1.0 mm and a width (W) of about 0.5 mm, preferably a length (L) of about 0.6 mm and a width (W) of about 0.3 mm, and more preferably a length (L) of about 0.4 mm and a width (W) of about 0.2 mm Meanwhile, according to an aspect, the height (or thickness (T)) of the coil component according to the present disclosure is preferably 0.95 mm or less and more preferably 0.55 mm or less.

Next, a method for manufacturing the coil component 1 will be described. In this regard, FIGS. 4A to 4J are plan views illustrating the method for manufacturing the coil component 1, and FIGS. 5A to 5J are sectional views showing a cross section cut along line a-a in FIG. 4A.

Production of Magnetic Sheet (Element Assembly Sheet)

Metal particles (filler) and a resin material are prepared. The metal particles and other filler components (a glass powder, a ceramic powder, a ferrite powder, and the like), as the situation demands, are wet-mixed with the resin material so as to form a slurry, a sheet having a predetermined thickness is formed by using a doctor blade method or the like, and drying is performed. In this manner, a magnetic sheet of a composite material of the metal particles and the resin is produced.

Photosensitive Conductor Paste

Conductive particles, for example, a Ag powder is prepared. A predetermined amount of the conductive particles are mixed with a varnish prepared by mixing a solvent and an organic component so as to produce a photosensitive conductor paste.

Photosensitive Glass Paste

A glass powder is prepared. A predetermined amount of the glass powder is mixed with a varnish prepared by mixing a solvent and an organic component so as to produce a photosensitive glass paste.

Shape-Retaining Photosensitive Paste

A material that disappears at a firing stage and, as the situation demands, an inorganic material powder that does not sinter at a firing stage are prepared. Examples of the material that disappears at a firing stage include organic materials, preferably the above-described varnish. Examples of the above-described inorganic material include ceramic powders such as alumina. The D50 of the inorganic material is preferably about 0.1 μm or more and 10 μm or less (i.e., from about 0.1 μm to 10 μm). A predetermined amount of the inorganic material powder that does not sinter at a firing stage is mixed with a varnish prepared by mixing a solvent and an organic component so as to produce a shape-retaining photosensitive paste.

Production of Element

Figure 4A:
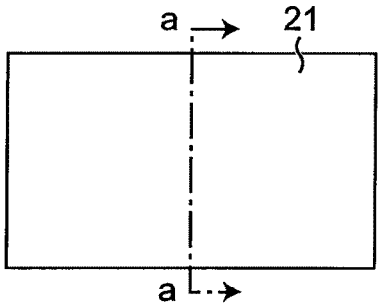
FIGS. 4A to 4J are plan views illustrating a method for manufacturing the coil component according to the embodiment.
Figure 5A:
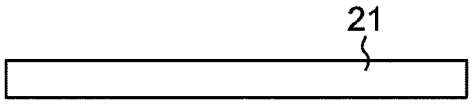
FIGS. 5A to 5J are sectional views illustrating a method for manufacturing the coil component according to the embodiment.

A sintered ceramic substrate 21 is prepared as a substrate (FIG. 4A and FIG. 5A).

Figure 4B:
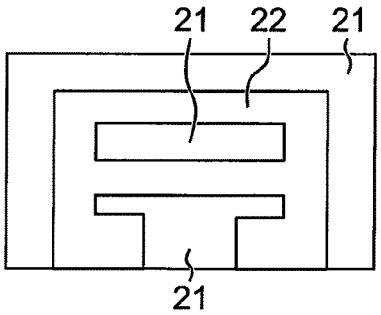
Figure 5B:
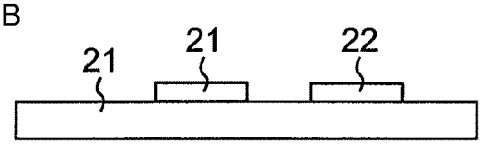

A glass paste layer 22 is formed of the photosensitive glass paste on the substrate 21 by using a photolithography method. Specifically, the glass paste layer 22 is formed by applying the photosensitive glass paste, performing photo-curing through a mask, and performing development (FIG. 4B and FIG. 5B).

Figure 4C:
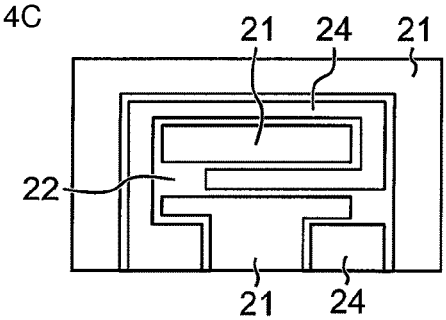
Figure 5C:
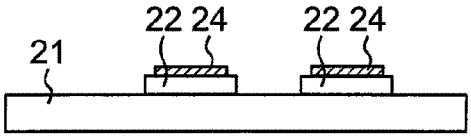

A conductor paste layer 24 is formed on the glass paste layer 22 by using the photolithography method. Specifically, the conductor paste layer 24 is formed by applying the photosensitive conductor paste, performing photo-curing through a mask, and performing development. The conductor paste layer 24 is formed inside the glass paste layer 22 formed in advance (FIG. 4C and FIG. 5C). As the situation demands, the conductor paste layer 24 having a predetermined thickness may be formed by repeating the above-described procedure. The conductor paste layer 24 formed in such steps corresponds to one of the first conductor layers 8*a*.

Figure 4D:
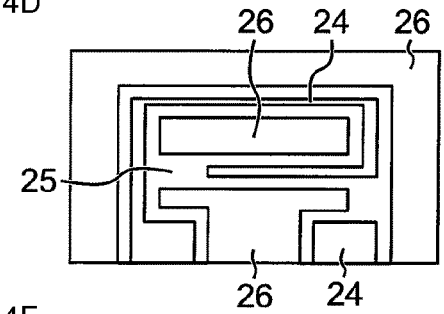
Figure 5D:
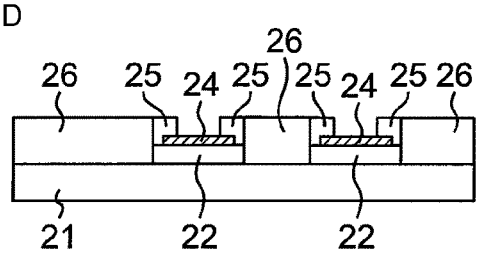

A glass paste layer 25 is formed on the glass paste layer 22 and the conductor paste layer 24 by using the photolithography method. Specifically, the glass paste layer 25 is formed so as to cover the glass paste layer 22 and the outer edge portion of the conductor paste layer 24 by applying the photosensitive glass paste, performing photo-curing through a mask, and performing development. Next, a shape-retaining paste layer 26 is formed of the shape-retaining photosensitive paste in the periphery of the glass paste layer 25 by using the photolithography method. Specifically, the shape-retaining paste layer 26 is formed in the periphery of the glass paste layer 25 by applying the shape-retaining photosensitive paste, performing photo-curing through a mask, and performing development (FIG. 4D and FIG. 5D). As the situation demands, the glass paste layer 25 and the shape-retaining paste layer 26 having predetermined thicknesses may be formed by repeating the above-described procedure.

Figure 4E:
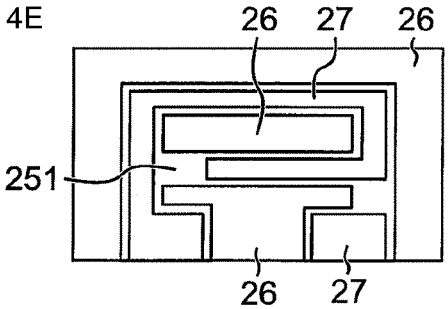
Figure 5E:
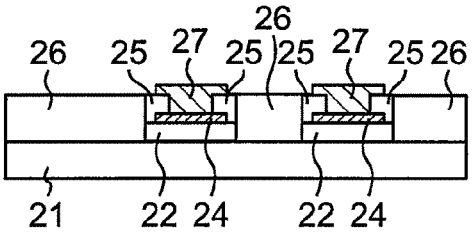

A conductor paste layer 27 is formed on the conductor paste layer 24 and the glass paste layer 25 by using the photolithography method. Specifically, the conductor paste layer 27 is formed by applying the photosensitive conductor paste, performing photo-curing through a mask, and performing development. The conductor paste layer 27 is formed inside the glass paste layer 25 formed in advance (FIG. 4E and FIG. 5E). As the situation demands, the conductor paste layer 27 having a predetermined thickness may be formed by repeating the above-described procedure. Regarding the conductor paste layer 27 formed in such steps, the portion surrounded by the glass paste layer 25 corresponds to one of the second conductor layers 8*b*, and the portion thereon (portion located upper than the glass paste layer 25) corresponds to one of the first conductor layers 8*a*.

Figure 4F:
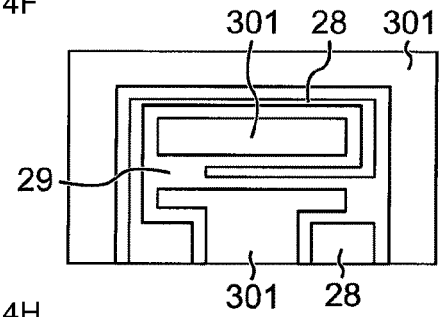
Figure 5F:
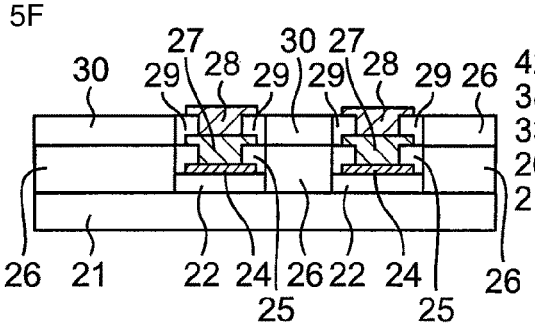

Subsequently, in the same steps as that shown in FIGS. 4D and 4E and FIGS. 5D and 5E, a glass paste layer 29, a shape-retaining paste layer 30, and a conductor paste layer 28 are formed (FIGS. 4F and 5F). Regarding the conductor paste layer 28 formed in such steps, the portion surrounded by the glass paste layer 29 corresponds to one of the second conductor layers 8*b*, and the portion thereon (portion located upper than the glass paste layer 29) corresponds to one of the first conductor layers 8*a*.

Figure 4G:
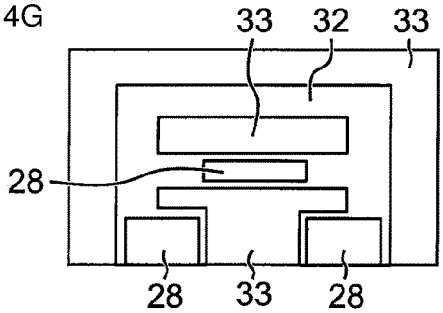
Figure 5G:
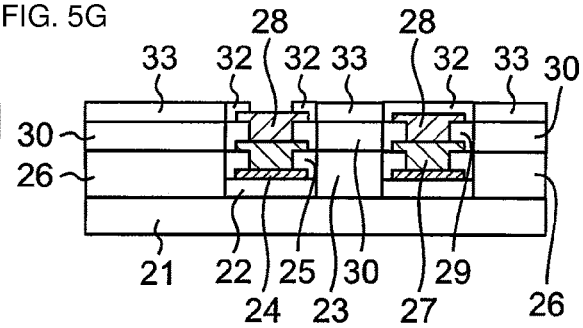

A glass paste layer 32 is formed on the glass paste layer 29 and the conductor paste layer 28 by using the photolithography method. Specifically, the glass paste layer 32 is formed so as to cover the glass paste layer 29 and the conductor paste layer 28 by applying the photosensitive glass paste, performing photo-curing through a mask, and performing development. The glass paste layer 32 is formed so as to expose the region serving as a connection portion between the conductor paste layer 28 and the conductor paste layer 35. Next, a shape-retaining paste layer 33 is formed of the shape-retaining photosensitive paste in the periphery of the glass paste layer 32 by using the photolithography method. Specifically, the shape-retaining paste layer 33 is formed in the periphery of the glass paste layer 32 by applying the shape-retaining photosensitive paste, performing photo-curing through a mask, and performing development (FIG. 4G and FIG. 5G). As the situation demands, the glass paste layer 32 and the shape-retaining paste layer 33 having predetermined thicknesses may be formed by repeating the above-described procedure.

The conductor paste layer 24, the conductor paste layer 27, and the conductor paste layer 28 that are formed as described above constitute a coil conductor.

Figure 4H:
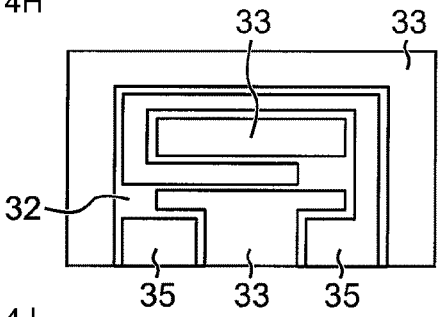
Figure 5H:
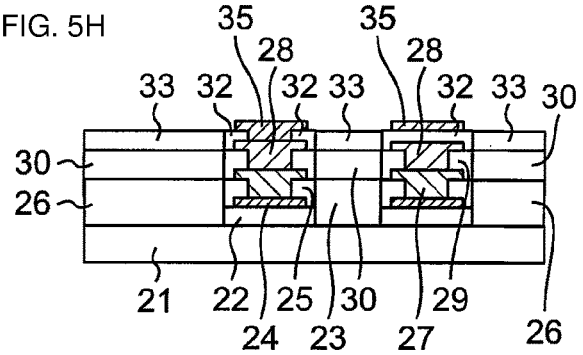

A conductor paste layer 35 is formed on the exposed portions of the glass paste layer 32 and the conductor paste layer 28 by using the photolithography method. Specifically, the conductor paste layer 35 is formed by applying the photosensitive conductor paste, performing photo-curing through a mask, and performing development. The conductor paste layer 35 is formed inside the glass paste layer 32 formed in advance (FIG. 4H and FIG. 5H). As the situation demands, the conductor paste layer 35 having a predetermined thickness may be formed by repeating the above-described procedure. Regarding the conductor paste layer 35 formed in such steps, the portion surrounded by the glass paste layer 32 corresponds to the connection conductor 8*c*, and the portion thereon (portion located upper than the glass paste layer 32) corresponds to one of the first conductor layers 8*a*.

Figure 4I:
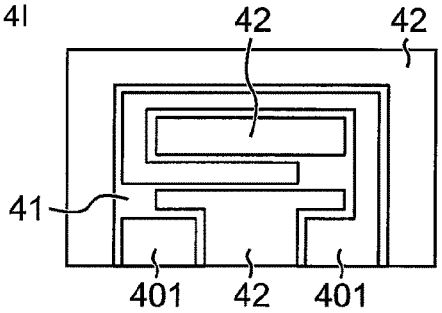
Figure 5I:
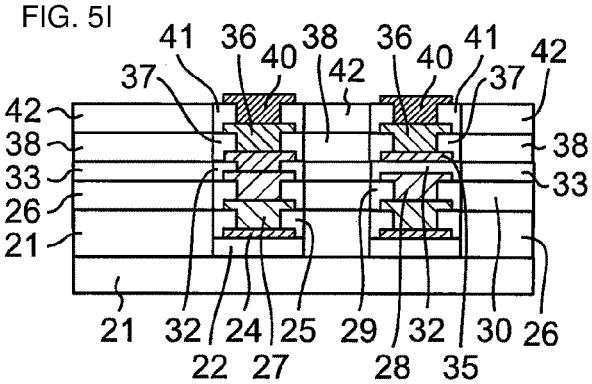

A glass paste layer 37, a shape-retaining paste layer 38, a conductor paste layer 36, a glass paste layer 41, a shape-retaining paste layer 42, and a conductor paste layer 40 are formed by repeating the steps shown in FIGS. 4D and 4E and FIGS. 5D and 5E two times (FIG. 4I and FIG. 5I). Regarding the conductor paste layer 36 formed in such steps, the portion surrounded by the glass paste layer 37 corresponds to one of the second conductor layers 8*b*, and the portion thereon (portion located upper than the glass paste layer 37) corresponds to one of the first conductor layers 8*a*. Meanwhile, regarding the conductor paste layer 40, the portion surrounded by the glass paste layer 41 corresponds to one of the second conductor layers 8*b*, and the portion thereon (portion located upper than the glass paste layer 41) corresponds to one of the first conductor layers 8*a*.

Figure 4J:
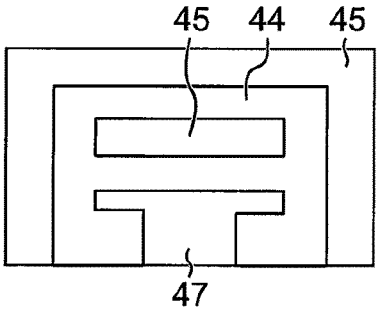
Figure 5J:
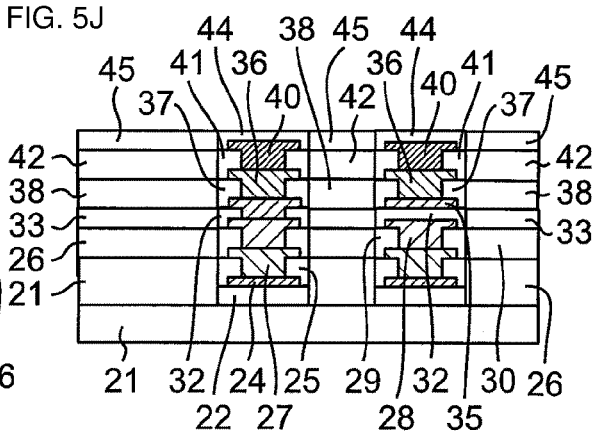

A glass paste layer 44 is formed on the conductor paste layer 40 by using the photolithography method. Specifically, the glass paste layer 44 is formed so as to cover the conductor paste layer 40 by applying the photosensitive glass paste, performing photo-curing through a mask, and performing development. Next, a shape-retaining paste layer 45 is formed of the shape-retaining photosensitive paste in the periphery of the glass paste layer 44 by using the photolithography method. Specifically, the shape-retaining paste layer 45 is formed in the periphery of the glass paste layer 44 by applying the shape-retaining photosensitive paste, performing photo-curing through a mask, and performing development (FIG. 4J and FIG. 5J). As the situation demands, the glass paste layer 44 and the shape-retaining paste layer 45 having predetermined thicknesses may be formed by repeating the above-described procedure.

In this manner, a multilayer body is formed on the substrate.

Figure 6A:
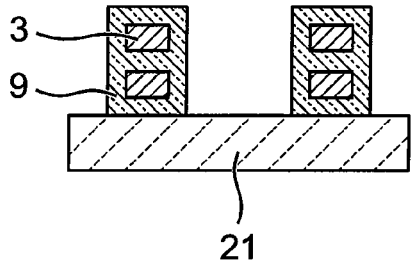
FIGS. 6A to 6D are sectional views illustrating a method for manufacturing the coil component according to the embodiment.

The resulting multilayer body is fired at a temperature of about 650° C. to 950° C. The organic material in the shape-retaining paste layer disappears during firing, and the inorganic material that does not sinter, for example, alumina, remains as powder without sintering. The coil portion 3 covered with the glass layer 9 is obtained on the substrate by removing the inorganic material powder (FIG. 6A). The coil portion 3 covered with the glass layer 9 is in close contact with the substrate 21. Therefore, there are advantages in handling, for example, transportation.

Figure 6B:
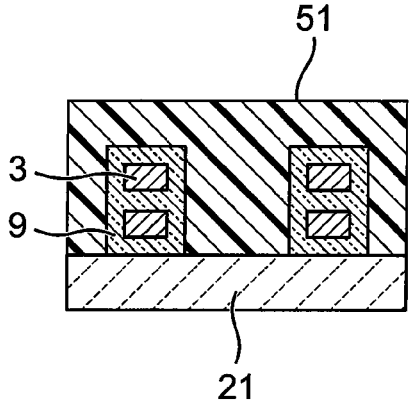

The magnetic sheet is pressed into the coil portion 3. A magnetic sheet 51 may be placed on the coil portion 3 and pressurized by a die or the like so as to be pressed into the coil portion 3 (FIG. 6B).

Figure 6C:
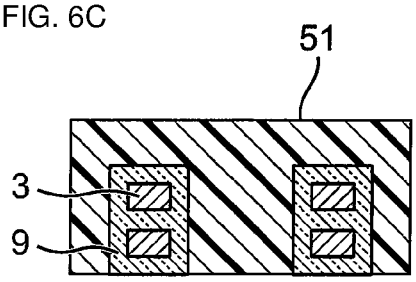

The substrate 21 is removed by grinding or the like (FIG. 6C).

Figure 6D:
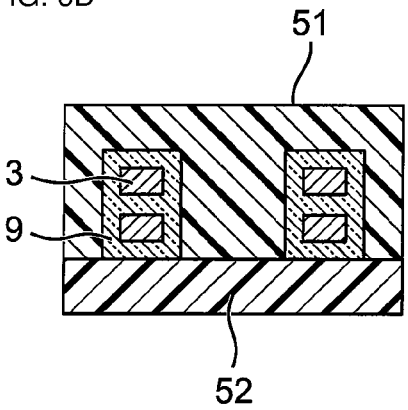

Another magnetic sheet 52 is made to come into close contact with the surface, from which the substrate 21 has been removed, by pressing or the like (FIG. 6D). Thereafter, cutting is performed by a dicer or the like so as to separate the individual element assemblies from each other.

An insulating layer 10 is formed on the entire surface of the resulting element assembly 2. The insulating layer may be formed by using a known method. For example, a method in which the element surface is covered by spraying an insulating material or a method in which dipping into an insulating material is performed may be used.

Figure 7A:
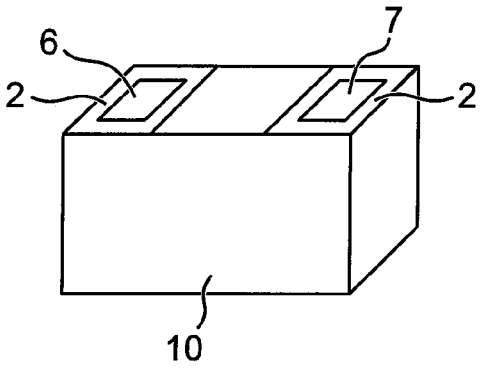
FIGS. 7A to 7C are perspective views illustrating a method for manufacturing the coil component according to the embodiment.

The insulating layer 10 is removed from regions, in which the outer electrodes are to be formed, of the element assembly 2. Removal may be performed by laser irradiation or a mechanical technique (FIG. 7A).

Figure 7B:
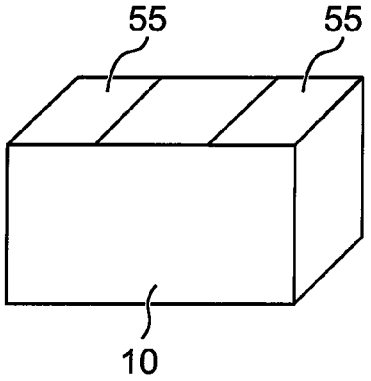
Figure 7C:
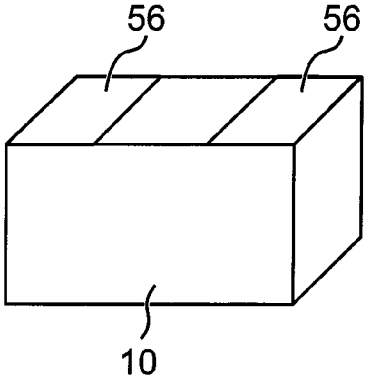

Next, a Cu layers 55 is formed (FIG. 7B). Forming the Cu layer enables the outer electrode to be formed favorably even on the element assembly having low electrical conductivity. Subsequently, a Ni layer and a Sn layer are formed successively by plating so as to serve as the plating layer 56 (FIG. 7C).

In this manner, the coil component 1 according to an embodiment of the present disclosure is produced.

According to the above-described method, a coil component having a thick coil conductor and low direct-current resistance can be obtained.

Accordingly, the present disclosure provides a method for manufacturing a coil component including an element assembly containing a filler and a resin material, a coil portion composed of a coil conductor embedded in the element assembly, and a pair of outer electrodes electrically coupled to the coil conductor, wherein the coil conductor is covered with a glass layer, the method including the steps of (1) forming, on a substrate, a glass paste layer of a photosensitive glass paste that contains glass constituting the glass layer, (2) forming a conductor paste layer, on the glass paste layer, of a photosensitive metal paste that contains a metal constituting the coil conductor, (3) forming a glass paste layer, on the glass paste layer formed in (1) and the outer edge of the conductor paste layer formed in (2), of the photosensitive glass paste that contains glass constituting the glass layer, and (4) forming the conductor paste layer, on the conductor paste layer formed in (2) and the glass paste layer formed in (3), of the photosensitive metal paste that contains a metal constituting the coil conductor.

In a preferred aspect, the conductor paste layer and the glass paste layer are formed by using a photolithography method in the above-described manufacturing method.

According to the above-described method, since the glass paste layer formed in step (3) is formed so as to be put on the outer edge of the conductor paste layer formed in step (2) (FIG. 5D), the height of the glass paste layer is readily increased, and a thicker coil conductor is readily formed.

Up to this point, the coil component and the method for manufacturing the same according to the present disclosure have been described. However, the present disclosure is not limited to the above-described embodiment, and the design change can be performed within the bounds of not departing from the gist of the present disclosure.

In the above-described embodiment, the element assembly is formed by using the magnetic sheet that is a composite material containing the filler and the resin material, and the element assembly is not subjected to a firing step. However, the coil component according to the present disclosure is not limited to this.

According to an aspect, regarding the coil component according to the present disclosure, the element assembly 2 may be formed by forming the filler portion of the element assembly through firing and, thereafter, by filling gap portions with a resin.

According to another aspect, the element assembly 2 may be formed by casting a slurry that contains a composite material containing the filler and the resin material and by heat-curing the resulting slurry.

According to another aspect, each outer electrode may be formed by pressing a magnetic sheet into the coil portion, performing heat-curing so as to obtain an element assembly, baking Ag onto the element assembly so as to form an underlying electrode, and applying Ni plating and Sn plating thereon.

According to another aspect, each outer electrode may be formed by pressing a magnetic sheet into the coil portion, performing firing so as to obtain a sintered material, baking Ag onto the sintered material so as to form an underlying electrode, impregnating gaps of the sintered material with a resin, and finally, applying Ni plating and Sn plating.

According to another aspect, after the coil portion is obtained, an element assembly may be obtained by casting a slurry that contains a composite material containing the filler and the resin material and by heat-curing the resulting slurry, and outer electrodes may be formed on the element assembly.

The coil component according to the present disclosure is widely used in various applications, for example, inductors.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element assembly containing a filler and a resin material;

a coil portion composed of a coil conductor embedded in the element assembly; and a pair of outer electrodes electrically coupled to the coil conductor, wherein at least one thin first conductor layer and at least one thick second conductor layer are stacked in the coil conductor, the at least one thick second conductor layer has a thickness greater than a thickness of the at least one first conductor layer, and the element assembly is not fired, and the coil portion is fired.

2. The coil component according to claim 1, wherein the at least one first conductor layer is a plurality of first conductor layers, and the second conductor layer is interposed between the first conductor layers.

3. The coil component according to claim 2, wherein the at least one first conductor layer is a plurality of first conductor layers, and the second conductor layer and the first conductor layers are stacked alternately, and the outermost layer is one of the first conductor layers.

4. The coil component according to claim 2, wherein a width of the first conductor layer is larger than a width of the second conductor layer.

5. The coil component according to claim 2, wherein the coil conductor is covered with a glass layer.

6. The coil component according to claim 2, wherein the coil conductor is covered with a glass layer having a thickness of from 3 μm to 30 μm.

7. The coil component according to claim 2, wherein a thickness of the coil conductor is from 10 μm to 500 μm.

8. The coil component according to claim 1, wherein the at least one first conductor layer is a plurality of first conductor layers, and the second conductor layer and the first conductor layers are stacked alternately, and the outermost layer is one of the first conductor layers.

9. The coil component according to claim 8, wherein a width of the first conductor layer is larger than a width of the second conductor layer.

10. The coil component according to claim 8, wherein the coil conductor is covered with a glass layer.

11. The coil component according to claim 8, wherein the coil conductor is covered with a glass layer having a thickness of from 3 μm to 30 μm.

12. The coil component according to claim 8, wherein a thickness of the coil conductor is from 10 μm to 500 μm.

13. The coil component according to claim 1, wherein a width of the first conductor layer is larger than a width of the second conductor layer.

14. The coil component according to claim 13, wherein the coil conductor is covered with a glass layer.

15. The coil component according to claim 13, wherein the coil conductor is covered with a glass layer having a thickness of from 3 μm to 30 μm.

16. The coil component according to claim 13, wherein a thickness of the coil conductor is from 10 μm to 500 μm.

17. The coil component according to claim 1, wherein the coil conductor is covered with a glass layer.

18. The coil component according to claim 17, wherein a thickness of the coil conductor is from 10 μm to 500 μm.

19. The coil component according to claim 17, wherein the glass layer contains a second filler.

20. The coil component according to claim 1, wherein the coil conductor is covered with a glass layer having a thickness of from 3 μm to 30 μm.

21. The coil component according to claim 1, wherein a thickness of the coil conductor is from 10 μm to 500 μm.

22. The coil component according to claim 1, wherein the filler contains metal particles, and the metal particles are covered with an insulating coating film that has a thickness of from 1 nm to 100 nm.

23. The coil component according to claim 1, wherein the coil portion includes at least one extended portion that extends from a winding portion of the coil portion and is electrically coupled to a respective one of the outer electrodes, and a width of the extended portion is greater than a width of the winding portion.

* * * * *